US011261870B2

(12) United States Patent
Kupp et al.

(10) Patent No.: US 11,261,870 B2
(45) Date of Patent: Mar. 1, 2022

(54) PUMP CASING WITH ADAPTIVE PRIMER AND IMPELLER

(71) Applicant: ITT Manufacturing Enterprises LLC, Wilmington, DE (US)

(72) Inventors: Edward Kupp, Wilmington, DE (US); Mark Playford, Wilmington, DE (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 273 days.

(21) Appl. No.: 16/587,118

(22) Filed: Sep. 30, 2019

(65) Prior Publication Data

US 2021/0095672 A1 Apr. 1, 2021

(51) Int. Cl.
*F04D 9/02* (2006.01)
*F04D 1/00* (2006.01)

(52) U.S. Cl.
CPC ..... *F04D 9/02* (2013.01); *F04D 1/00* (2013.01); *F05D 2260/95* (2013.01)

(58) Field of Classification Search
CPC . F04D 9/02; F04D 1/00; F04D 29/628; F04D 29/2205; F04D 29/426; F05D 2260/95; F05D 2230/51; F05D 2230/61
See application file for complete search history.

(56) References Cited

U.S. PATENT DOCUMENTS 2,944,489 A * 7/1960 Longenecker ..... F04D 9/02 415/56.4
3,191,539 A * 6/1965 Davenport ..... F04D 29/428 415/148
3,499,388 A * 3/1970 Eberhardt ..... F04D 29/126 415/132
3,967,915 A * 7/1976 Litzenberg ..... F04D 13/0606 415/211.1
4,052,133 A * 10/1977 Yeater ..... F04D 29/4293 415/200
4,057,361 A * 11/1977 Renaud ..... F04D 9/005 415/56.4
2009/0116958 A1* 5/2009 Wiggins ..... F04D 29/428 415/203

FOREIGN PATENT DOCUMENTS

JP 2018178855 A * 11/2018

* cited by examiner

*Primary Examiner* — Brian P Wolcott
(74) *Attorney, Agent, or Firm* — Hertzberg, Turk & Associates, LLC

(57) ABSTRACT

Technologies are generally described for pump devices that include an adaptive cutwater and impeller arrangement. The power end of the pump device can be coupled to a motor to drive an impeller. The primer plate and impeller of the pump device are removable from the pump casing such that the primer plate and impeller can be replaced or modified as desired for different applications. In some examples, the pump casing includes a primer plate that is removable from the pump casing, where the primer plate includes a discharge cutwater tongue that is specifically spaced and sized to service an impeller of a desired design. The discharge cutwater tongue and impellers in the pump device may thus be serviced for replacement parts, as well as to modify the pump device for different fluids of different fluids properties or hydraulic requirements as may be needed in different applications.

19 Claims, 10 Drawing Sheets

PUMP CASING WITH ADAPTIVE PRIMER AND IMPELLER

BACKGROUND

Unless otherwise indicated herein, the materials described in this section are not prior art to the claims in this application and are not admitted as prior art by inclusion in this section.

A centrifugal pump is a mechanical device designed to move a fluid by transferring rotational energy through driven rotors to impellers. Fluid enters the centrifugal pump at an inlet, where the impeller is located. A motor is utilized to rotate a shaft that is connected to the impeller, thereby controlling the rotation of the impeller. The rotational motion of the impeller generates a centrifugal force that increases the velocity of the fluid so that the fluid flows through the pump casing to an outlet. At start up, a centrifugal pump has a flooded suction line surrounding the impeller with sufficient water to create a pressure differential and thus pumping the fluid.

A self-priming centrifugal pump has a water reservoir built into the unit which enables it to rid pump and suction line of air by recirculating water within the pump on priming cycle allowing the pump to be mounted above the liquid. During the priming cycle, air enters the pump and mixes with water at the impeller. Water and air are discharged together by centrifugal action of the impeller. The air naturally rises and separates from the water and discharges out of the casing, while the water flows back into the priming chamber where it is mixed again with air from the suction line. Once all air has been evacuated from the suction line, the liquid floods the impeller, and pumping operation begins. For proper operation in the priming cycle, the clearance between the impeller and the discharge volute is closely held to ensure the liquid-air mixture is expelled and will not simply recirculate around with the rotating impeller. When the impeller is trimmed, the cutwater volute is modified to maintain this close clearance.

The design of the centrifugal pump depends on the type of fluid and the desired flow rate. Some typical applications of pumps include water supplies, circulation pumps, irrigation pumps, and chemical transfer pumps.

SUMMARY

The present disclosure generally describes pump devices with a removeable portion to configure and/or customize the pump for different applications.

According to some examples, a pump apparatus is disclosed with a pump casing, a primer plate with a discharge cutwater tongue, and an impeller. The pump casing has a power end mounting face. The primer plate with the discharge cutwater tongue is configured to be removeable from the pump casing about the power end mounting face. The impeller is also configured to be removable and is placed in cooperative alignment with the primer plate about the discharge cutwater tongue. The impeller is configured to engage a power end of the pump when coupled to the power end mounting face. The discharge cutwater tongue is paired to the impeller for priming operation of the pump.

In some further examples, the pump apparatus further comprises a seal ring positioned between the primer plate and the pump casing.

In various examples, an inner ridge may be formed along an interior portion of the pump casing about the power end mounting face, and a seal ring may be configured to be placed along the inner ridge of the pump casing to seal the contact points between the primer plate and the pump casing.

In further examples, mounting studs may be configured to affix the primer plate to the pump casing. The mounting studs may each comprise one or more of a smooth rod, a threaded rod, a partially threaded rod, a screw, or a bolt. In still other examples, the mounting studs may have a first end and a second end, where the first end is affixed to the primer plate and the second end is affixed to the pump casing.

In some examples, the described pump may further comprise a face gasket that is positioned between the primer plate and the pump casing.

In some further examples, a pump may further comprise a second primer plate with a second discharge cutwater tongue, wherein the second primer plate is configured to be modularly replaced. A second impeller may be configured to be removably placed in cooperative alignment with the primer plate about the discharge cutwater tongue; wherein the second impeller is configured to replace the original impeller. The second impeller may be operable at a different hydraulic performance rating requiring a diameter change.

In still other examples, a pump may further comprise a driver that is coupled to the driver mounting face, where the driver includes a shaft that is operatively configured to engage and rotate the impeller.

In some examples, a pump apparatus may comprise a pump casing, an inner ridge, a primer plate, a seal ring, and an impeller. The pump casing may have a power end mounting face. The inner ridge may be formed along an interior portion of the pump casing about the power end mounting face. The primer plate may have a discharge cutwater tongue, wherein the primer plate is configured to be removably placed in the pump casing about the power end mounting face. The seal ring may be configured to be placed along the inner ridge of the pump casing to seal the contact points between the primer plate and the pump casing. The impeller may be configured to be removably placed in cooperative alignment with the primer plate about the discharge cutwater tongue. The impeller may also be configured to engage a power end when coupled to the power end mounting face, and wherein the discharge cutwater tongue is paired to the impeller for priming operation of the pump.

In still another example, a pump apparatus may comprise a pump casing, an inner ridge, a primer plate, a seal ring, mounting studs, and an impeller. The pump casing may have a power end mounting face. The inner ridge may be formed along an interior portion of the pump casing about the power end mounting face. The primer plate may have a discharge cutwater tongue, wherein the primer plate is configured to be removably placed in the pump casing about the power end mounting face. The seal ring may be configured to be placed along the inner ridge of the pump casing to seal the contact points between the primer plate and the pump casing. The mounting studs may have a first end and a second end, wherein the first end is affixed to the primer plate and the second end is affixed to the pump casing. The impeller may be configured to be removably placed in cooperative alignment with the primer plate about the discharge cutwater tongue. The impeller may be configured to engage a power end when coupled to the power end mounting face, and wherein the discharge cutwater tongue is paired to the impeller for priming operation of the pump.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1A:
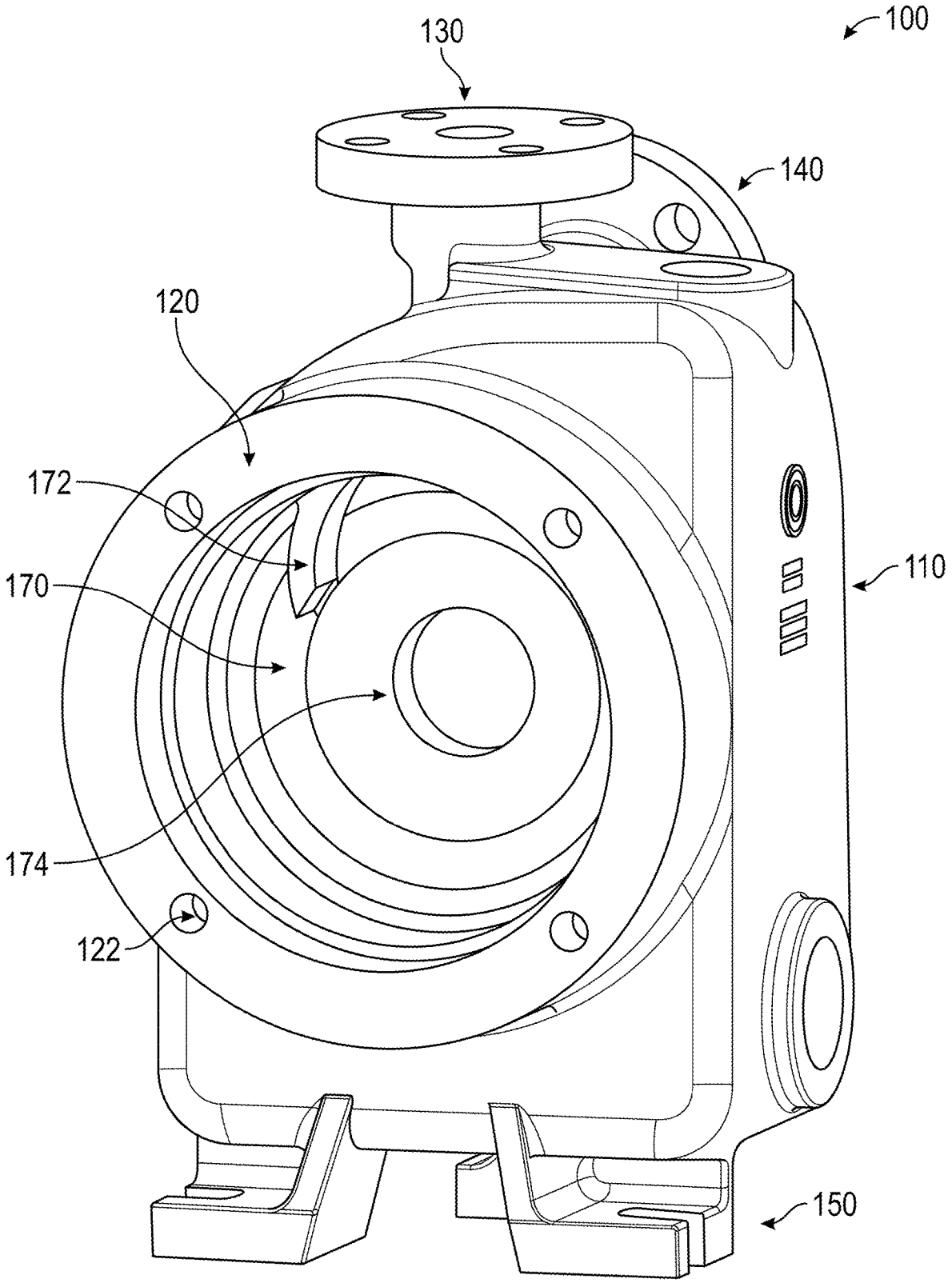
FIGS. 1A-1D illustrate pump devices with an adaptive primer plate and impeller.

all arranged in accordance with at least some embodiments described herein.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. The aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems and/or devices that are configured for use in a pump casing with an adaptive primer plate and impeller arrangement.

Briefly stated, technologies are generally described for pumps that include an adaptive primer plate and impeller arrangement. The power end of the pump can be coupled to a motor to drive an impeller. The primer plate and impeller of the pump are removeable from the pump casing such that the primer plate and impeller can be replaced as desired for different applications. In some examples, the pump casing includes a primer plate that is removable from the pump casing, where the primer plate includes a discharge cutwater tongue that is specifically spaced and sized to match an impeller of a desired design. The primer plates and impellers in the pump may thus be serviced for replacement parts, as well as to modify the pump for different hydraulic ratings as may be needed in different applications.

The present disclosure recognizes that the selection of the impeller in a pump is important to generate sufficient pressure at the proper flow. However, the impeller selection depends in part on the type of liquid that is flowing in the pump. A different design of an impeller (e.g., different diameter, shape, size, material) may be needed for different fluids. For example, pressure head difference between the inlet and the outlet, or "total developed head" produced by a pump, is proportional to the speed of the impeller and the diameter of the impeller. Thus, to obtain a higher head, either the rotational speed of the impeller or the diameter of the impeller may need to be increased. Additionally, a different design of an impeller may be needed (e.g., different materials), for different types of fluids. Thus, the present disclosure appreciates that differently designed pumps may be used for each type of fluid based on their differences in fluid properties.

Self-priming centrifugal pumps should be primed before operation. This will ensure that air or gases are expelled from the internal mechanisms and replaced with enough liquid so that the impeller is surrounded by liquid and suction pressure is sufficient for proper pumping action. The primer plate design for the pump should be closely aligned and gapped with respect to the impeller so that impeller operates efficiently. When the pump is fully primed the chambers (volutes) will perform properly in discharging fluid at the correct rate and volume. The pump casing is thus designed with a particular primer plate and discharge cutwater tongue so that an adequate volume of liquid is forced into the internal chambers for priming and re-priming.

In some examples, the gap between the primer plate and the impeller may be equal to or less than about 0.0625 inches. In some other examples, the gap between the primer plate and the impeller may be less than about 5% of the actual impeller diameter. In still other examples, the gap between the primer plate and the impeller may be less than about 0.25 inches. In various examples, the specific ranges of gaps may be in any range of these described points. For example, a specific gap like 0.0625" has a value that may be within a range of less than or equal to about 5% of the impeller diameter. In another example, a larger specific distance like 0.25" or less may be within a range of less than about 4% of the impeller diameter. Additional gap ranges are also contemplated, such as ranges of gaps that are less than or equal to about 3%, 4%, 5% or 6% of the impeller diameter. Any appropriate gap value may be utilized provided that the selected gap value generates sufficient movement of the air liquid mixture to the priming chamber for proper priming operation without recirculating in the casing volute.

Disclosed herein are methods and devices to make pump primer plates and impellers easily serviced after manufacturing. This replacement can be to improve efficient operation by replacement of a worn impeller or mismatched impeller-cutwater tongue pairing. Additionally, as described herein, pumps can be easily modified with the disclosed modular components so that pumps can be repurposed for different types of fluids with varying fluid properties. By facilitating a modular impeller and primer plate design, pumps can be easily reconfigured to operate with great efficiency. The modular design can also reduce waste since pumps can be repurposed, thus operating costs are reduced.

FIGS. 1A-1D illustrate pump devices 100 with an adaptive primer plate and impeller that is arranged in accordance with at least some embodiments described herein.

As illustrated in FIG. 1A, some example pump devices 100 may include a pump casing 110 with a power end mounting face 120, an outlet mounting flange 130, an inlet mounting flange 140, a mounting base 150, and a primer plate 170. Power end mounting face 120 may be located about a first side (e.g., front side) of the pump casing 110. Outlet mounting flange 130 may be located about a second side (e.g., top side) of the pump casing 110. Inlet mounting flange 140 may be located about a third side (e.g., back side) of the pump casing 110. Mounting base 150 may be located about a fourth side (e.g., bottom side) of the pump casing 110. The primer plate 170 may be located within an interior portion of the pump casing 110 and positioned to align with the power end mounting face 120, as will be described in more detail later.

The primer plate 170 may be substantially ring shaped with a ring aperture 174 and a perimeter located discharge cutwater tongue 172. In some examples, the cutwater tongue 172 extends along the perimeter of primer plate 170 with an arc that is inwards to the location of an impeller (not shown). The exact location of the mounting portions (e.g., faces and flanges) are design choices that may be altered to accommodate different applications.

Power end mounting face 120 includes mounting holes 122 that are dispersed about the surface and configured to couple with a power end assembly (not shown). The mounting holes may be threaded to accept bolts, screws, or other threaded and/or machined coupling devices. In some examples the power end mounting face may be arranged as a flanged portion with through holes that may accept bolts either threaded or through holes to mate with retaining nuts or other types of couplers.

Figure 1B:
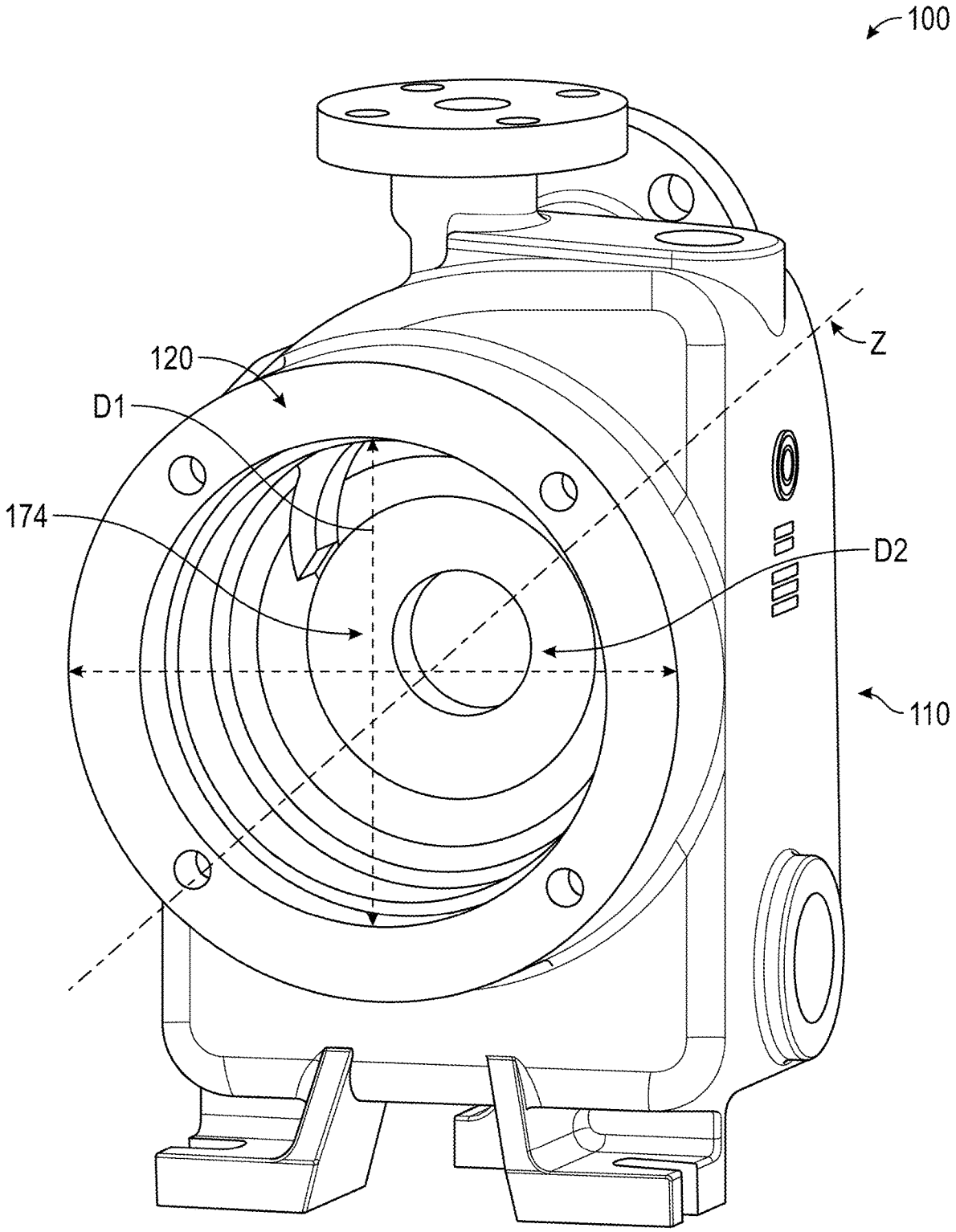

As further illustrated in FIG. 1B, the power end mounting face 120 may be substantially ring shaped with the ring portion being substantially bounded by an inner diameter D1, and an outer diameter D2, with respect to an axis Z of the pump casing 110. Primer plate 170 may be substantially located in the pump casing 110, aligned with the opening of the power end mounting face 120, with the ring aperture 174 also aligned about the axis Z of the pump casing 110. Thus, the outer diameter of primer plate 170 may be substantially bounded by diameter D1.

Figure 1C:
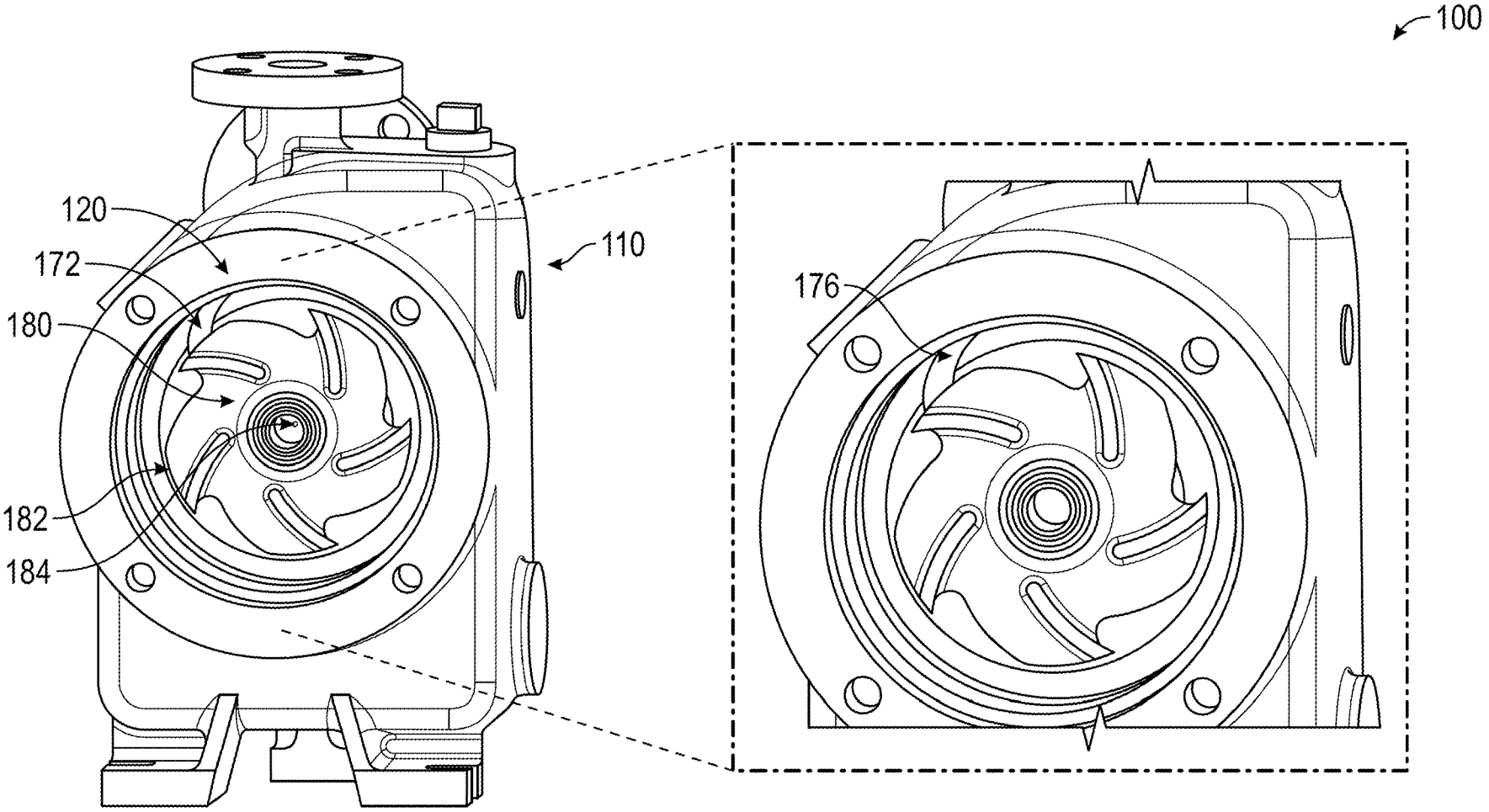

As illustrated in FIG. 1C, an impeller 180 can be placed in the pump casing 110 within the interior portion of the power end mounting face 120 and mated against the primer plate 170. The impeller is rotationally aligned about axis Z of the pump casing 110, where a central portion 184 of impeller 180 is configured to engage with a shaft of the power end (not shown) when the driver is coupled to the pump casing 110. The shape and size of the vanes 182 on the impeller may be selected to accommodate a particular type of fluid with particular fluid properties. The cutwater tongue 172 and the impeller 180 are expected to operate with a tight running clearance 176. The outer diameter of the impeller 180 is bounded by the diameter D1.

In some examples, the running clearance or clearance gap between the cutwater tongue and the impeller is on the order of about 1/16". However, other clearance gaps are also contemplated. For example, in some applications the clearance gap may be less than 1/16" or greater than 1/16". In various examples, the clearance gap may be on the order of 1/8", 1/2", or perhaps larger or smaller in dimension based on the specific pumping requirements. In some applications the clearance gap may be in a range from about 1/16" to about 1/8"; while in other applications the clearance gap may be in a range from about 1/16" to about 1/4"; or in a range from about 1/8" to about 1/2".

As will be described in further detail later, the primer plate 170 and the impeller 180 are removeable such that the cutwater tongue 172 and the impeller 180 can be replaced or modified in the field after manufacturing. This means that the pump can be adapted in the field for a variety of different applications. The impeller 180 can be shaped, refined or replaced to improve efficiency or as needed to accommodate different fluids with different fluid properties or different desired flow rates. The matching cutwater tongue 172 can also be changed by replacing the primer plate 170 so that the clearance between the new impeller and the cutwater tongue can be adapted in the field for better efficiency in operation.

Figure 1D:
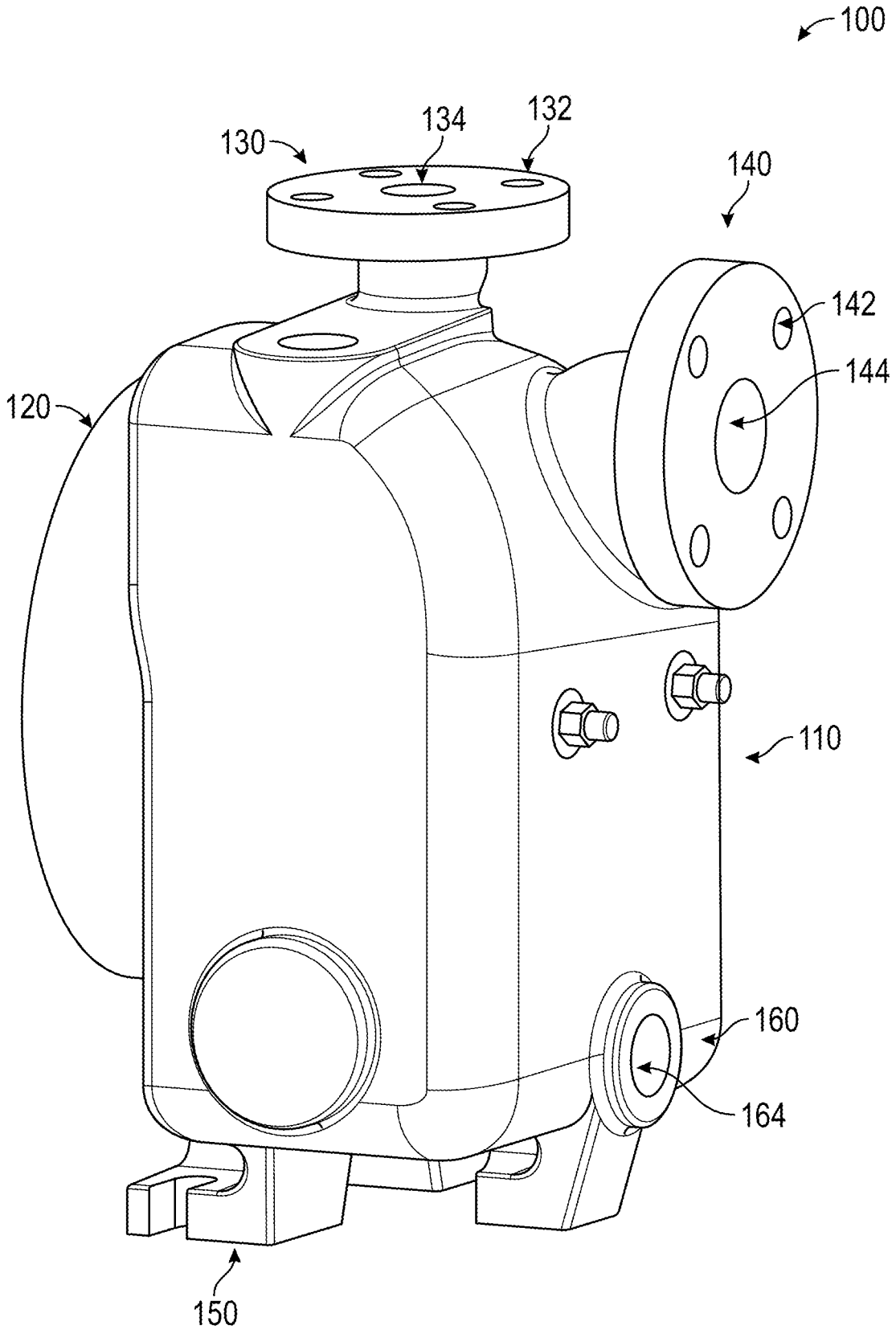

FIG. 1D further illustrates the various mounting flanges and related fluid ports. For example, outlet mounting flange 130 may include a flange surface with mounting holes 132 and fluid discharge port 134; while inlet mounting flange 140 may include a flange surface with mounting holes 142 and inlet port 144. Additional mounting points are illustrated such as rear mounting surface 160 and a draining port 164.

Figure 2A:
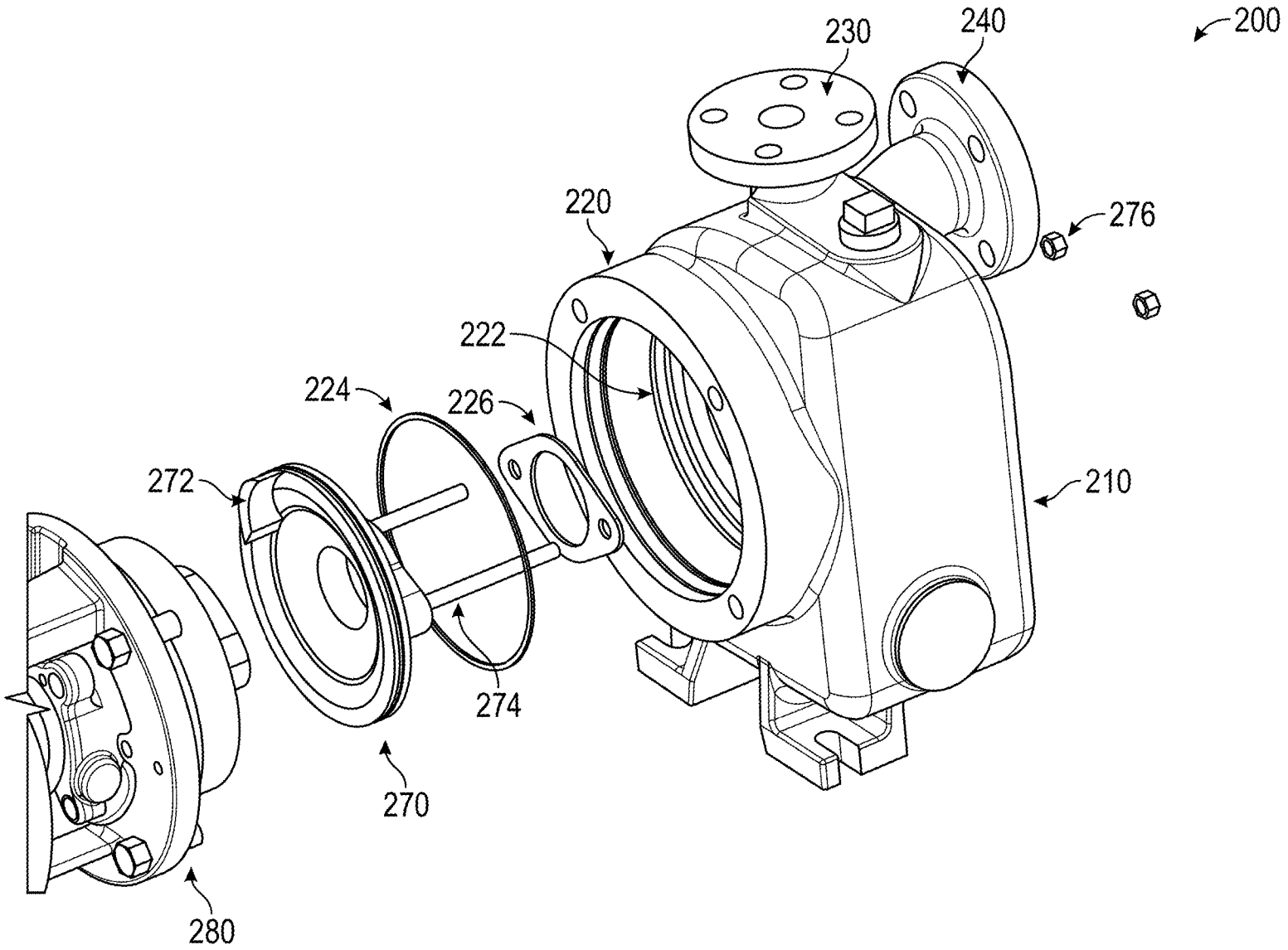
FIG. 2A-2B illustrate an assembly view of a pump device with an adaptive primer plate with an impeller.
Figure 2B:
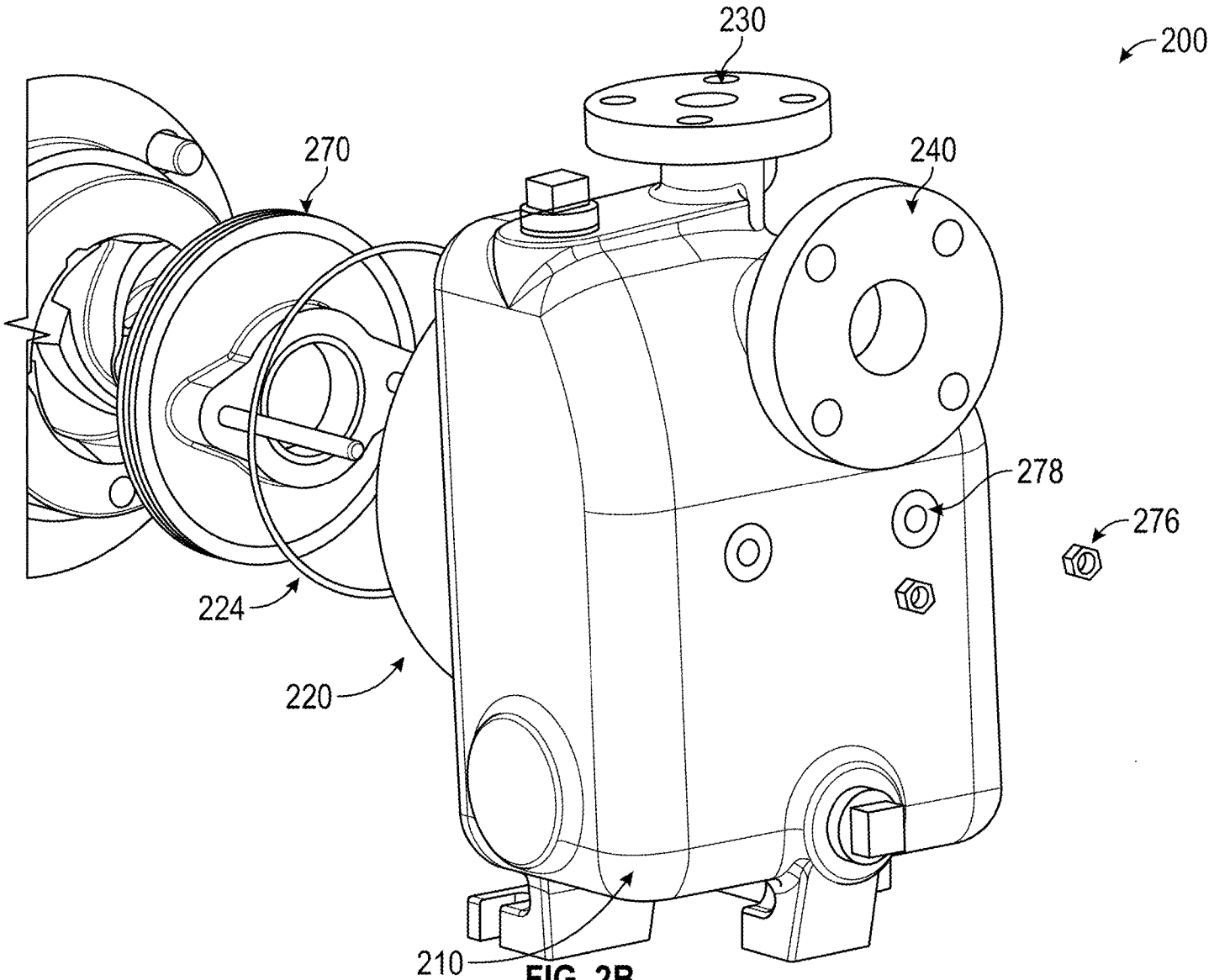

FIG. 2A-2B illustrate an assembly view of a pump device 200 with an adaptive primer plate and impeller arranged in accordance with embodiments of the present disclosure. As illustrated, pump device 200 may include a pump casing 210 with a power end mounting face 220, an outlet mounting flange 230, an inlet mounting flange 240, and a primer plate 270. Angled primer plate 270 may include a discharge cutwater tongue 272 and mounting studs 274. Similar to FIGS. 1A-1D, the discharge cutwater tongue 272 may be located on a perimeter of the angled primer plate 270 with an angled portion that arcs inwards towards the impeller (not shown).

Mounting studs 274 may be configured to affix the angled primer plate 270 to the pump casing 210. The mounting studs may be smooth, threaded or a combination thereof. In some examples, the mounting studs are formed as a smooth rod. In other examples the mounting studs are formed as a threaded rod. In still other examples the mounting studs are formed by a partially threaded rod. In still further examples, the mounting studs are formed as a screw or bolt.

Each of the mounting studs (e.g., a plurality of mounting studs) may have two ends; a first end may be located at the primer plate 270 and a second end may be located at the backside of the pump casing 210; passing through holes 278 placed in the pump casing 210 around the perimeter of the suction volute wall and extending longitudinally in the direction between the power end mounting face 220 and the backside of the pump casing 210 along the Z-axis (similar to FIGS. 1A-1D). For example, the first end of the mounting studs 274 may be affixed (by welding, or threaded screw or other fastener) to the primer plate 270 while the second end may be affixed to the pump casing 210 by fasteners such as one or more nuts 276. In another example, bolts or screws may be inserted at the backside of the pump casing 210 and extending through the pump casing 210 to engage the primer plate 270; where retaining nuts would not be necessary in this example.

The method of affixing the mounting studs can be varied. For example, the mounting studs 274 may alternatively be implemented as screws or bolts that are inserted from the backside of the pump casing 210 and terminating at the primer plate with a threaded mount.

The mounting studs 274 may also extend through a face gasket 226; which is a generally ring-shaped structure that is positioned between the pump casing 210 and the primer plate 270. The face gasket 226 seals the liquid stored in the priming chamber 390 from entering into the suction volute 392 during priming cycles and seals holes 278 in the pump casings that the mounting studs 274 pass through to mount the primer plate 270 to the pump casing 210.

A seal ring 224 (e.g., an O-ring) can be positioned between the angled primer plate 270 and pump casing 210, wherein the seal ring is configured to seal the contact points between the primer plate 270 and the pump casing 210. In some examples, the pump casing includes an inner ridge 222 that is formed along an interior portion of the pump casing 210 about the power end mounting face 220. The seal ring 224 may be configured to engage the inner ridge 222 of the pump casing 210 and the angled primer plate 270 such that the primer plate 270 is sealed to the pump casing 210. As will be shown in more detail later, a power end 280 is adapted to couple to the pump casing 210 such that a shaft (not shown) is engaged with the impeller; in proper position about the primer plate 270.

Figure 3:
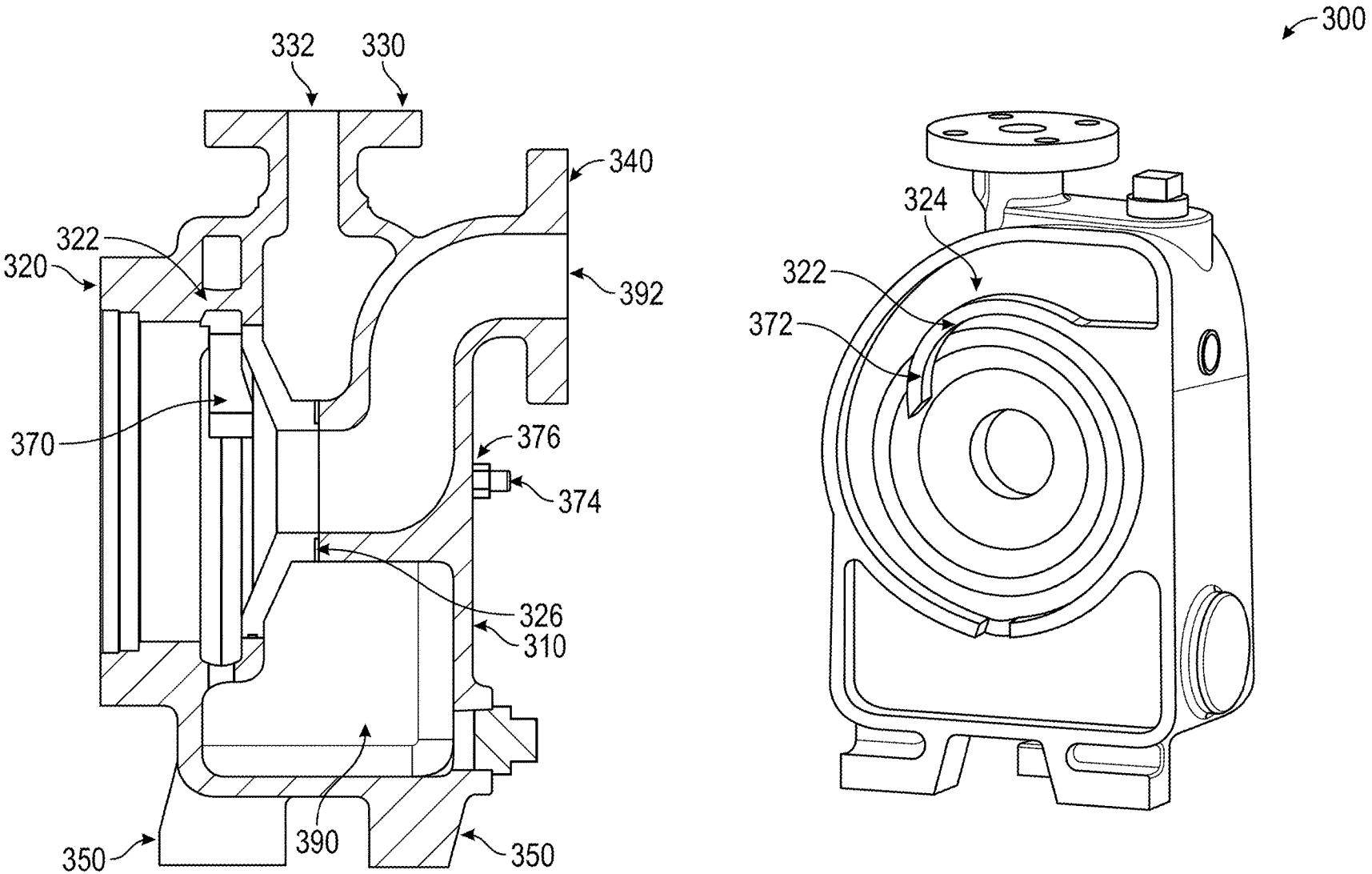
FIG. 3 illustrates a cutaway view of a pump device with an adaptive primer plate and impeller.

FIG. 3 illustrates a cutaway view of a pump device 300 with an adaptive primer plate and impeller arranged in accordance with at least some embodiments described herein. Pump device 300 may include a pump casing 310 with a power end mounting face 320, an outlet 332, an outlet mounting flange 330, an inlet mounting flange 340, a mounting base 350, primer plate 370, face gasket 326, priming chamber 390, and a suction volute 392.

Similar to FIGS. 2A-2B, in FIG. 3 the primer plate 370 is affixed in the pump casing 310 using mounting studs 374 that extend longitudinally from the primer plate 370 to a side (e.g., the back side) of the pump casing 310, where the mounting studs 374 are secured by fasteners 376 (e.g., nuts). The pump casing 310 may include a ridged region 322, which forms the discharge volute 324, this ridge is a continuation of the discharge cutwater tongue 372 on the primer plate 370

Figure 4:
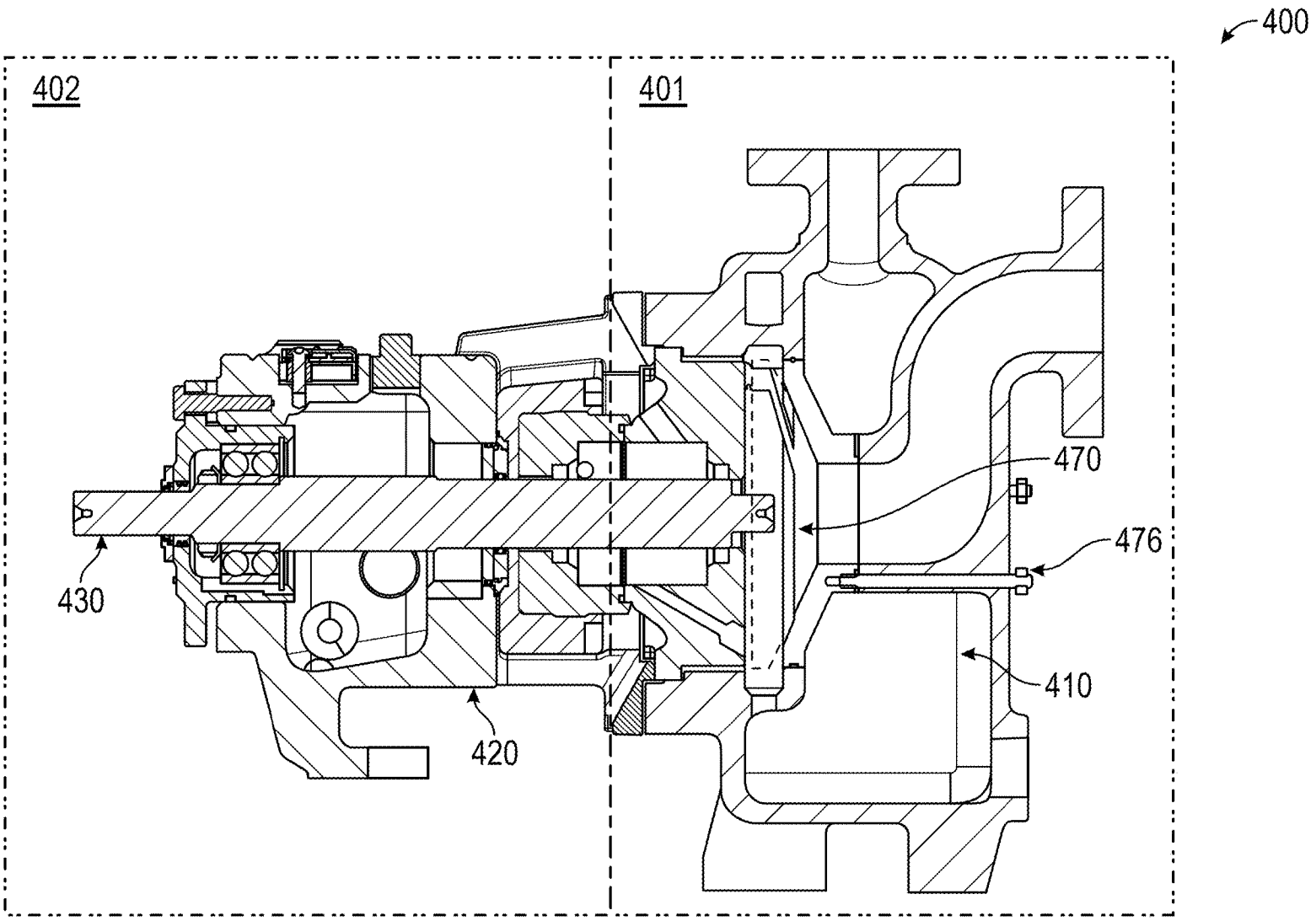
FIG. 4 illustrates a cutaway view of power end coupled to a pump device with an adaptive primer plate and impeller.

FIG. 4 illustrates a cutaway view of power end coupled to a pump device with an adaptive primer plate and impeller arranged in accordance with at least some embodiments described herein. As illustrated, the assembly 400 includes a pump liquid end 401 that is coupled to a power end 402. A shaft 430 extends through the cover of the casing 420 of the power end 402 into the casing 410 of the pump liquid end 401. The pump liquid end 401 further includes a primer plate 470 that is affixed to the pump casing 410 via mounting fasteners 476.

Figure 5A:
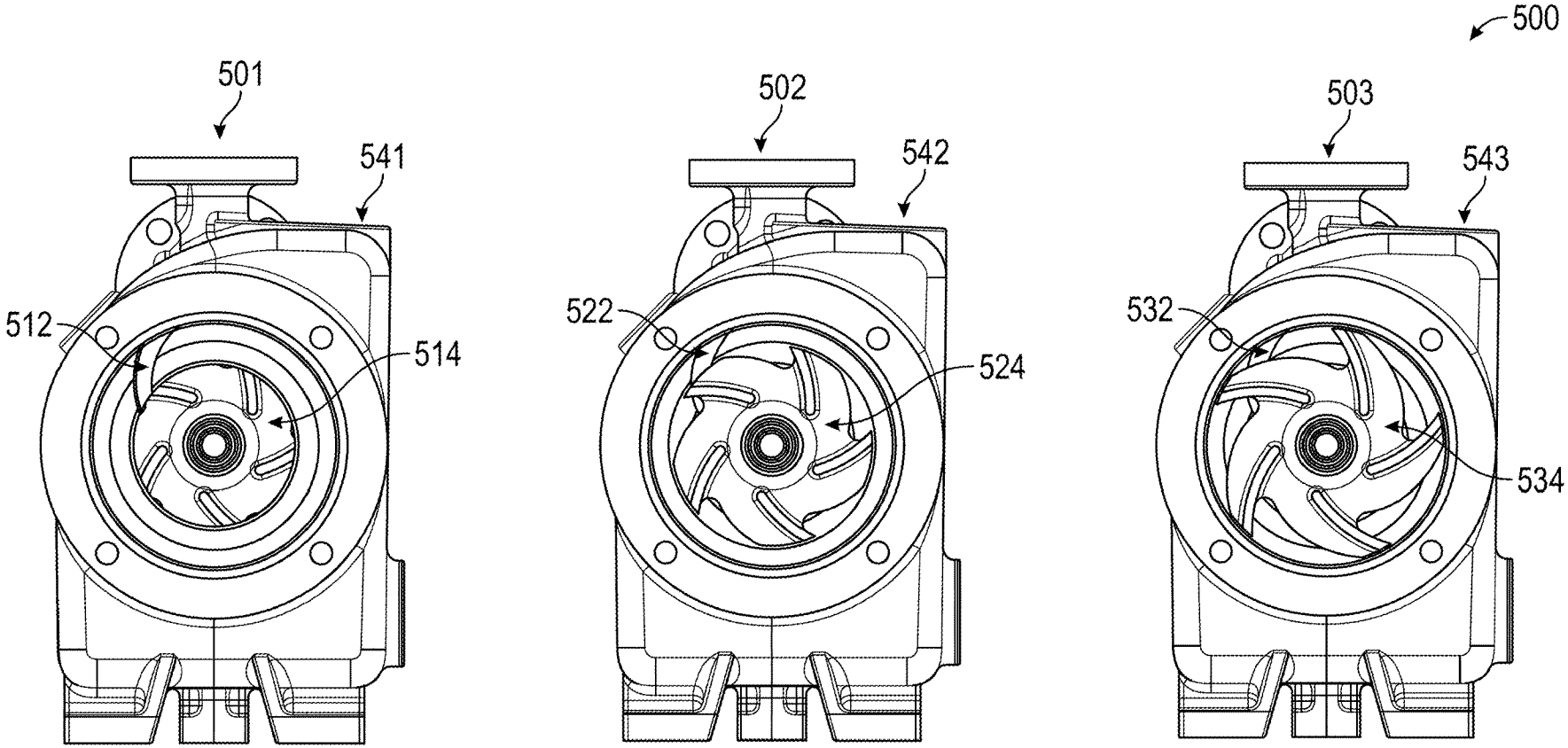
FIGS. 5A-5B includes various primer plates and impellers that are suitable for a configurable pump.
Figure 5B:
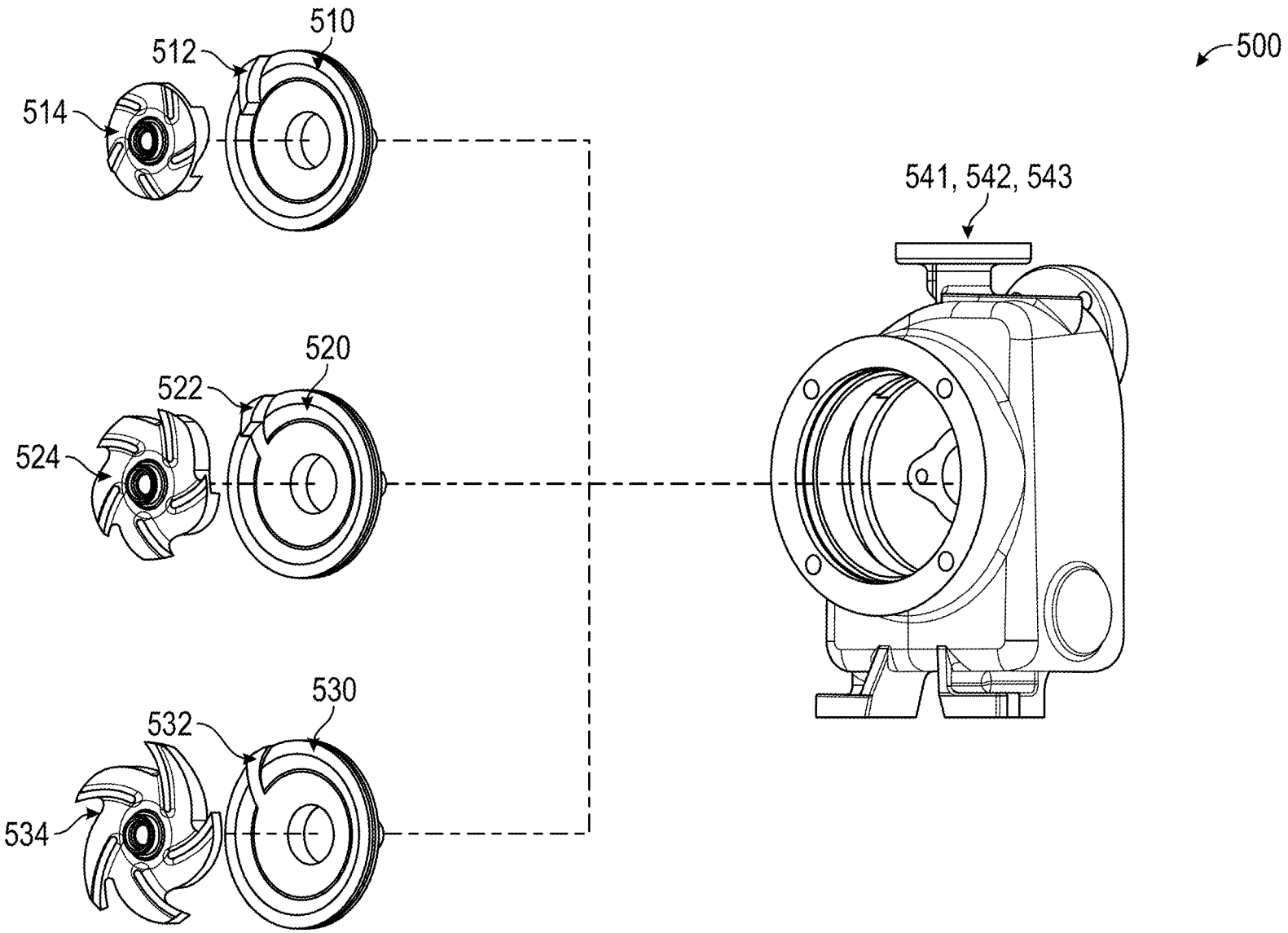

FIGS. 5A-5B includes various primer plates and impellers 500 that are suitable for a configurable pump arranged in accordance with at least some embodiments described herein. Three examples 501, 502 & 503 are illustrated; although any number of other examples are also contemplated. Example 501 illustrates a pump casing 541, with a primer plate 510 that includes a discharge cutwater tongue 512 and an impeller 514. Example 502 illustrates a pump casing 542, with a primer plate 520 that includes a discharge cutwater tongue 522 and an impeller 524. Example 503 illustrates a pump casing 543, with a primer plate 530 that includes a discharge cutwater tongue 532 and an impeller 534.

Each of the illustrated primer plates are adapted for removeable/replaceable use within a pump such as those illustrated herein. Primer plates are selected according to their use with a particular impeller based on the running clearance requirements and the diameter of the impeller selected. As illustrated by the various examples, impeller 514 is somewhat rounded in shape and does not have distinct vanes; while impeller 524 has medium sized vanes and impeller 534 has larger sized vanes. The primer plates for each impeller are matched with a corresponding discharge cutwater tongue that is positioned to ensure a tight running clearance as previously discussed. Thus, the primer plate and impeller are specifically paired for cooperative operation and efficient priming/pumping action by maintaining the required running clearance.

The benefits of the presently disclosed pump devices are numerous. For example, the methods and devices employed herein enable pumps to be easily serviced after manufacturing. The primer plate (e.g., discharge cutwater tongue) and impeller can be retooled or replaced as a modular component without replacing the pump casing, thus reducing operating costs. Additionally, the corresponding pump can be easily modified for a new use with different fluids of differing fluid properties; or to accommodate differing flow rates and pressure as may be needed in new applications.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled. The terminology used herein is for the purpose of describing particular embodiments only and is not intended to be limiting.

The herein described subject matter sometimes illustrates different components contained within, or connected with, different other components. Such depicted architectures are merely examples, and in fact, many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically connectable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

For any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments are possible. The various aspects and embodiments disclosed herein are for purposes of illustration and are not intended to be limiting, with the true scope and spirit being indicated by the following claims.

What is claimed is:

1. A pump apparatus comprising:

a pump casing having a power end mounting face;

a primer plate with a discharge cutwater tongue, wherein the primer plate is configured to be removably placed in the pump casing about the power end mounting face;

a seal ring positioned between the primer plate and the pump casing; and an impeller that is configured to be removably placed in cooperative alignment with the primer plate about the discharge cutwater tongue, wherein the impeller is configured to engage a power end when coupled to the power end mounting face, and wherein the discharge cutwater tongue is paired to the impeller for a priming operation of the pump.

2. The pump apparatus of claim 1, further comprising:

an inner ridge formed along an interior portion of the pump casing about the power end mounting face, wherein the seal ring is configured to be placed along the inner ridge of the pump casing to seal contact points between the primer plate and the pump casing.

3. The pump apparatus of claim 1, further comprising mounting studs configured to affix the primer plate to the pump casing and position the discharge cutwater tongue to a pump casing discharge volute.

4. The pump apparatus of claim 3, wherein the mounting studs each comprise one or more of a smooth rod, a threaded rod, a partially threaded rod, a screw, or a bolt.

5. The pump apparatus of claim 1, further comprising mounting studs having a first end and a second end, wherein the first end is affixed to the primer plate and the second end is affixed to the pump casing.

6. The pump apparatus of claim 5, wherein the mounting studs each comprise one or more of a smooth rod, a threaded rod, a partially threaded rod, a screw, or a bolt.

7. The pump apparatus of claim 3, further comprising a face gasket that is positioned between the primer plate and the pump casing.

8. The pump apparatus of claim 1, further comprising:

a second primer plate with a second cutwater tongue, wherein the second primer plate is configured to modularly replace the primer plate.

9. The pump apparatus of claim 1, further comprising:

a second impeller configured to replace the impeller, wherein the second impeller is further configured to be removably placed in cooperative alignment with the primer plate about the discharge cutwater tongue.

10. The pump apparatus of claim 9, wherein a material of the second impeller is operable in a corrosive fluid.

11. The pump apparatus of claim 1, further comprising:

a second primer plate with a second discharge cutwater tongue, wherein the second primer plate is configured to replace the primer plate; and a second impeller configured to replace the impeller to change one of a hydraulic performance or a wear, wherein the second impeller is further configured to be removably placed in cooperative alignment with the second primer plate about the second discharge cutwater tongue.

12. The pump apparatus of claim 1, further comprising a power end that is coupled to the power end mounting face, wherein the power end includes a shaft that is operatively configured to engage and rotate the impeller.

13. A pump apparatus comprising:

a pump casing having a power end mounting face;

an inner ridge formed along an interior portion of the pump casing about the power end mounting face;

a primer plate with a discharge cutwater tongue, wherein the primer plate is configured to be removably placed in the pump casing about the power end mounting face;

a seal ring configured to be placed along the inner ridge of the pump casing to seal contact points between the primer plate and the pump casing; and an impeller that is configured to be removably placed in cooperative alignment with the primer plate about the discharge cutwater tongue, wherein the impeller is configured to engage a power end when coupled to the power end mounting face, and wherein the discharge cutwater tongue is paired to the impeller for a priming operation of the pump apparatus.

14. The pump apparatus of claim 13, further comprising mounting studs configured to affix the primer plate to the pump casing.

15. The pump apparatus of claim 14, wherein the mounting studs each comprise a smooth rod, a threaded rod, a partially threaded rod, a screw, or a bolt.

16. The pump apparatus of claim 13, further comprising mounting studs having a first end and a second end, wherein the first end is affixed to the primer plate and the second end is affixed to the pump casing.

17. The pump apparatus of claim 16, wherein the mounting studs each comprise a smooth rod, a threaded rod, a partially threaded rod, a screw, or a bolt.

18. The pump apparatus of claim 13, further comprising a face gasket that is positioned between the primer plate and the pump casing.

19. A pump apparatus comprising:

a pump casing having a power end mounting face;

an inner ridge formed along an interior portion of the pump casing about the power end mounting face;

a primer plate with a cutwater tongue, wherein the primer plate is configured to be removably placed in the pump casing about the power end mounting face;

a seal ring configured to be placed along the inner ridge of the pump casing to seal contact points between the primer plate and the pump casing;

mounting studs having a first end and a second end, wherein the first end is affixed to the primer plate and the second end is affixed to the pump casing; and an impeller that is configured to be removably placed in cooperative alignment with the primer plate about the cutwater tongue, wherein the impeller is configured to engage a power end when coupled to the power end mounting face, and wherein the cutwater tongue is paired to the impeller for a priming operation of the pump apparatus.

* * * * *